US005297729A

United States Patent [19]

Scullion

[11] Patent Number: 5,297,729

[45] Date of Patent: Mar. 29, 1994

[54] FURNACE APPARATUS

[75] Inventor: Patrick J. Scullion, Taylor, Mich.

[73] Assignee: Combustion Concepts, Inc., Detroit, Mich.

[21] Appl. No.: 936,527

[22] Filed: Aug. 28, 1992

[51] Int. Cl.[5] ..... F24D 5/00

[52] U.S. Cl. ..... 237/53; 126/99 R; 126/110 C

[58] Field of Search ..... 237/50, 51, 53, 55; 126/99 A, 99 C, 110 R, 110 A, 99 R, 110 C, 110 D

*Primary Examiner*—Henry A. Bennett
*Attorney, Agent, or Firm*—Harness, Dickey & Pierce

[57] ABSTRACT

An improved heating system is disclosed for providing heated air to a heated space, preferably using a gaseous fuel as the energy source. The system preferably includes an air heating sub-system, a compact combustion chamber, a separate cold air supply sub-system for conveying cold air from the heated space to the air heating sub-system, a combustion chamber heat exchanger in fluid communication with the cold air supply sub-system for transferring heat thereto, and a separate air circulating sub-system for withdrawing cold circulating air from the heated space. A mixing chamber is provided for mixing heated air from the air heating sub-system with the cold circulating air to provide heated air to the space. The system also preferably includes separate sub-systems for supplying pressurized combustion air and pressurized gaseous fuel to the air heating sub-system and for forcibly conveying exhaust gases therefrom without the need for a draft-type chimney or stack. In one preferred embodiment, a vortex-type air separator separates higher temperature and lower temperature combustion air, with the higher temperature air being used for combustion and the lower temperature air being heated in an exhaust gas heat exchanger before being conveyed to the heated space. A novel control sub-system is also provided for controlling the system, preferably in response to both indoor and outdoor temperatures, and for minimizing the number of energy wasting on/off cycles in operating the system.

23 Claims, 3 Drawing Sheets

AIR CLEANER
COMBUSTION AIR COMP.
GAS SOURCE
GAS COMP.
COMB. CH.

FURNACE APPARATUS

CROSS-REFERENCE TO RELATED PATENT

Reference is made to the disclosure of related U.S. Pat. No. 4,669,656, which issued Jun. 2, 1987 to Mr. John W. Turko and having a common assignee as the present invention, and which is hereby incorporated by reference herein.

BACKGROUND AND SUMMARY OF THE INVENTION

The invention relates generally to heating systems primarily adapted to providing heated air to a space to be heated, such as a building or an enclosed portion thereof. More specifically, the invention relates to such a heating system fueled by a gaseous fuel, although the invention is also applicable to heating systems using other fuels.

Previous conventional forced-air heating systems for residential or commercial buildings, or for enclosed portions thereof, have included furnaces that burn a mixture of fuel and air in order to produce heat. Heat exchangers are included for transferring the heat from such combustion to an air flow system that is circulated through the heated space and then returned to the heat exchanger. Such conventional furnace systems have been found, however, to be wasteful in terms of their use of the thermal energy available from the combustion process, largely because exhaust gases are discharged into the atmosphere at considerably high temperatures, frequently in excess of 300 F. (149 C.), which is well in excess of the desired room temperature in the space to be heated.

Even the best of the above-described conventional furnace systems are estimated to waste up to fifteen percent to twenty percent of the gross heating value of the fuel consumed when operating at steady state conditions. Such waste of thermal energy is further compounded by the fact that when the furnace and the circulating fan of such conventional heating systems are shut off in response to a signal from a thermostat in the heated space, the typical draft-type chimney continues to draw warm air from the furnace and from inside the building and then discharges such warm air to the atmosphere. Then when the thermostat again calls for heat, the system must restart and warm up before being capable of supplying heated air. In the northern states of the United States, this on/off cycling operation is estimated to occur over twenty thousand times per year in a typical forced-air heating system, thus resulting in an overall loss or waste of thermal energy estimated to be approximately forty percent of the available heating value of the fuel consumed.

In addition to the above disadvantages, such conventional heating systems have become economically unfeasible in large residential or commercial structures requiring very high draft-type chimneys. Because of the low cost effectiveness of the construction and maintenance of such large chimneys, such heating systems have frequently been constructed and installed on the roof of such buildings, therefore complicating their installation and increasing their cost. Alternately, especially in multi-tenant or multi-dwelling residential or commercial buildings, electric heating systems have been installed in order to reduce the initial construction cost, allow individual heating control for multiple units of the building, and eliminate the need for the building management to account for, and separately re-bill, the cost of each unit's share of the overall cost of operating a centralized heating system. Such alternate electric heating systems have included electric resistance-type heating units or heat pumps, for example, but suffer the disadvantage of being relatively expensive to operate in comparison with heating systems fueled by gaseous fuels, such as natural gas.

Because of the above-discussed disadvantages and shortcomings of conventional forced-air heating system and of typical electric heating systems, one of the primary objects of the present invention is to provide a forced air heating system, preferably fueled by a gaseous fuel, that effectively uses a much higher percentage of the available heating value of the fuel being consumed and that more effectively recovers a high percentage of the thermal energy present in the exhaust gases discharged to the atmosphere.

Another object of the present invention is to provide such a heating system that does not require a conventional chimney or other draft-type exhaust gas discharge conduit.

Another object of the present invention is to provide a heating system that maximizes the control over the function of the heating system and operates at a lower thermal energy input, but that operates for longer periods of time, thereby minimizing the number of on/off cycles required to maintain a desired temperature in the heated space, thereby maximizing the efficiency of the heating system.

Still another object of the present invention is to provide a heating system that employs a separate system for air circulating at a relatively low velocity to and from the heated space and separate high-velocity air system for transferring the heat of combustion to the air supplied to the heated space, as well as providing separate pressurized combustion air and fuel supply systems that forcibly convey combustion exhaust gases out of the heating system.

In accordance with one aspect of the present invention, a heating system for heating a space generally includes an air heating sub-system with a relatively compact combustion chamber adapted for burning a mixture of combustion air and fuel in order to produce heat, a separate cold air supply sub-system for conveying cold air from the heated space to the air heating sub-system, a combustion chamber heat exchanger in fluid communication with the cold air supply sub-system for transferring heat from the combustion chamber to the cold air withdrawn from the heated space by the cold air supply sub-system, and a separate air circulating sub-system for withdrawing cold circulating air from the heated space. The heating system also preferably includes an air mixing chamber in fluid communication with both the combustion chamber heat exchanger and the air circulating sub-system for mixing heated air with cold circulating air in order to provide heated circulating air to the heated space.

In accordance with another aspect of the present invention, the heating system includes a combustion air supply sub-system having a combustion air compressor for supplying the combustion air to the combustion chamber at an elevated pressure, a gaseous fuel supply sub-system having a gaseous fuel compressor for conveying gaseous fuel from a gaseous fuel source to the combustion chamber at an elevated pressure substantially equal to the elevated pressure of the combustion air, with the pressure of the combustion air and the gaseous fuel being sufficient to forcibly convey the mixture of combustion air and gaseous fuel into the combustion chamber and to forcibly convey the products of combustion through a relatively small exhaust discharge conduit without the need for a draft-type chimney or conduit.

In accordance with still another aspect of the present invention, the combustion air supply sub-system for a heating system includes a separator device, such as a vortex-type separator, that separates combustion air above a predetermined temperature from combustion air that is below such predetermined temperature. Such higher temperature combustion air is conveyed to the combustion chamber of the heating system, and the relatively lower temperature combustion air is conveyed to an exhaust gas heat exchanger for transferring heat from the exhaust gas to such relatively lower temperature combustion air. The combustion air that has been heated in the exhaust gas heat exchanger is then conveyed back to the heated space in order to effectively recover thermal energy that would otherwise have been wasted as the exhaust gas from the combustion chamber is discharged to the atmosphere.

A further aspect of the present invention is the provision of combustion air and gaseous fuel bypass systems, including automatic bypass valves, for bypassing quantities of combustion air and gaseous fuel from the discharges to the intakes of the respective combustion air and gaseous fuel compressors. The bypass systems allow for selective control of the quantities of fuel and air being supplied to the combustion chamber in order to control the heat being supplied to the heated space without the need for the wasteful frequent on/off cycling operation mentioned above in connection with conventional heating systems. In addition, the heating system of the present invention preferably includes a microprocessor control system that operates and controls the above bypass systems and other components of the heating system in response to temperature input signals from both the heated space and the exterior surroundings.

Many or all of these objectives and features were obtained by the invention described and claimed in a previous patent, U.S. Pat. No. 4,669,656, issued Jun. 2., 1987, to the same inventor and assignee as the present invention. However, the present invention builds upon, and provides even further developments over, that of such previous patent.

Such developments include combustion chamber apparatuses that provide for an improved, more evenly distributed flame pattern that more efficiently and more effectively conveys the thermal energy of the preferred gaseous fuel to the surrounding heat exchanger device. Other of such developments include improved heat exchanger devices and arrangements for even more efficient, effective heat transfer to the air being heated. Also, an innovative remote pilot system can optionally be employed in conjunction with any or all of the various disclosed embodiments of the invention.

In this regard it should be emphasized that any of the improved combustion chamber, heat exchanger, or remote pilot developments disclosed herein can be interchangeably incorporated into, or combined with, the disclosed embodiments of the above-mentioned previous patent, either separately or in various combinations that will readily occur to those skilled in the art from the following discussion. Similarly, the corresponding components disclosed in such previous patent can be interchangeably incorporated into, or combined with, those disclosed herein. For this reason such previous patent, U.S. Pat. No. 4,669,656, is expressly incorporated by reference as part of the disclosure herein.

Additional objects, advantages and features of the present invention will become apparent from the following description and appended claims, taken in conjunction with the accompanying drawings.

DETAILED DESCRIPTION OF THE PREFERRED EMBODIMENTS

Figures 1, 9:
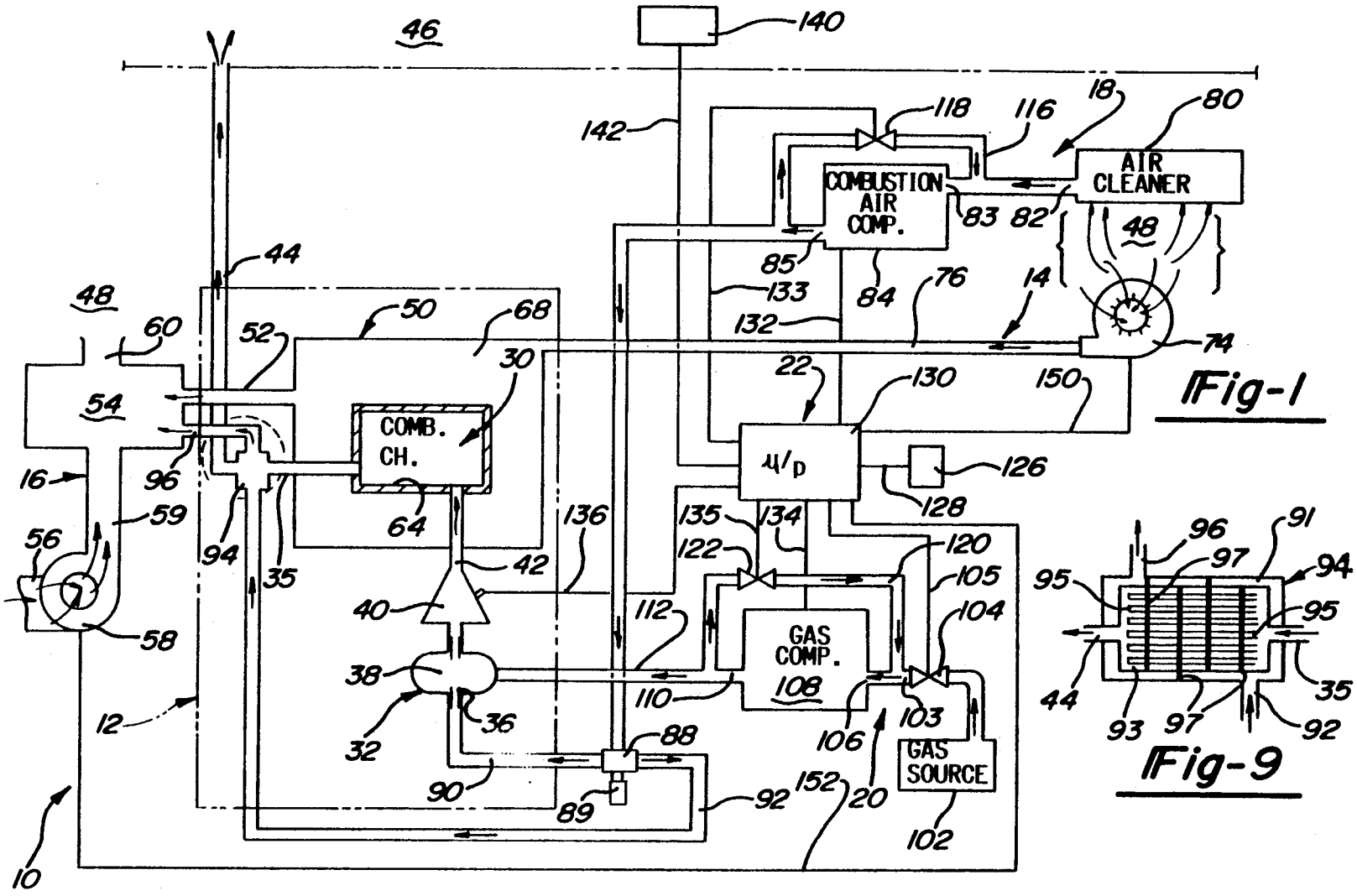
FIG. 1 is a schematic flow diagram of an exemplary heating system according to the present invention.
FIG. 9 is a detailed schematic flow diagram of one preferred exhaust gas heat exchanger of the heating system shown in FIG. 1.

FIGS. 1 through 9 depict in diagrammatic form various exemplary heating system embodiments for heating an enclosed space according to the present invention. As will become apparent from the following discussion, however, the principles of the present invention are not limited to the particular space heating application depicted diagrammatically in the drawings, and that the principles of the present invention are equally applicable to heating system arrangements other than that shown in the drawings.

Referring primarily to FIG. 1, an exemplary heating system 10 according to the present invention generally includes an air heating sub-system 12, a cold air supply sub-system 14, an air circulating sub-system 16, a combustion air supply sub-system 18, a gaseous fuel supply sub-system 20, and a control sub-system 22.

The air heating sub-system 12 includes a combustion chamber 30 adapted for combustion of a mixture of combustion air and a gaseous fuel respectively supplied to the combustion chamber 30 from the combustion air supply sub-system 18 and the gaseous fuel supply sub-system 20 described below.

In any of the combustion chamber embodiments, the combustion air and the gaseous fuel can optionally be mixed in adjustable and preselected proportions in an adjustable venturi device 32, which is in fluid communication with the combustion chamber 30 by way of an intake conduit 42. The mixture of gaseous fuel and combustion air is preferably ignited by an electronic ignition device 40, or other known ignition devices, disposed for fluid communication in the intake conduit 42, and injected into the combustion chamber 30. The combustion chamber 30 is preferably relatively small, preferably very close to the size of the flame of the burning fuel and air mixture itself, in order to minimize wasted energy in unnecessarily heating an empty space around the flame.

The optional adjustable venturi device 32 preferably includes a generally annular gas chamber 34 with a pair of externally-threaded inspirator tubes 36 threadably and adjustably engaged with peripheral portions of the gas chamber 34. The inspirator tubes are spaced apart within the gas chamber 34 to form an opening 38, the size of which is preselectively adjustable by threadably moving the inspirator tubes 36 toward or away from one another. Thus, for a particular application, the proportions of gaseous fuel and combustion air mixed together in the adjustable venturi device 32 can be preselectively adjusted in order to provide a range of fuel-to-air ratios that are consistent with the desired operating conditions in the particular application.

The air heating sub-system 12 also includes a small exhaust conduit 44 in fluid communication with the interior of the combustion chamber 30 for conveying the products of combustion from the combustion chamber 30 to the exterior or ambient surroundings 46 of the heated space 48. A combustion chamber heat exchanger 50 is also associated with the combustion chamber 30 and is adapted to transfer heat produced in the combustion chamber 30 to cold air supplied from the cold air supply sub-system 14 (described below) in order to produce heated air that is in turn conveyed through a heated air discharge conduit 52 to an air mixing chamber 54, which is part of the air circulating sub-system 16 described below. The combustion chamber heat exchanger 50 can include any of the exemplary embodiments shown in FIGS. 6 through 8, for example, and any of these heat exchanger embodiments can be employed in conjunction with any of the combustion chamber embodiments described herein.

The air circulating sub-system 16 generally includes a cold air return conduit 56 and a return air fan 58 for withdrawing cold air from the heated space 48 and conveying such cold air to the air mixing chamber 54 by way of a cold air conduit 59. The cold air from the air circulating sub-system 16 is mixed in the air mixing chamber 54 with heated air from the combustion chamber heat exchanger 50 and from an exhaust gas heat exchanger 94 (described below). Such mixing in the air mixing chamber 54 produces a heated air mixture that is conveyed, under the force of the return air fan 58, outwardly from the air mixing chamber 54 to the heated space 48 by way of one or more heated air supply conduits 60.

Cold air is supplied to the combustion air heat exchanger 30 from the heated space 48 by the cold air supply sub-system 14. Such cold air is withdrawn from the heated space by a cold air supply fan 74 and conveyed to the combustion chamber heat exchanger 30 by way of a cold air conduit 76.

Figure 2:
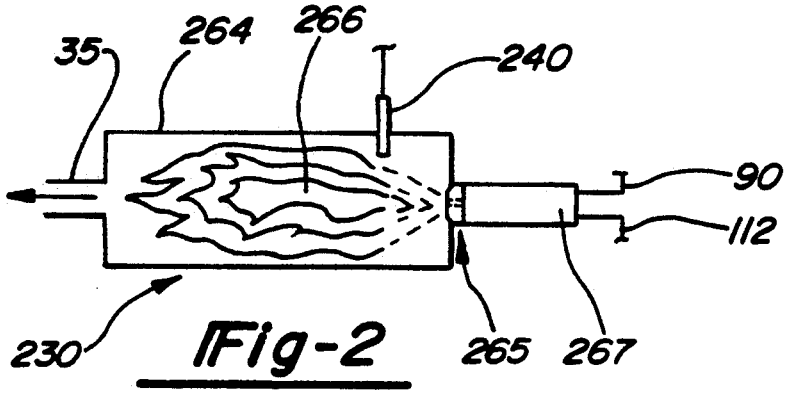
FIG. 2 is a detailed schematic representation of one embodiment of a combustion chamber for the heating system shown in FIG. 1.

In FIG. 2, one of the embodiments of the combustion chamber 30 of FIG. 1 is schematically represented by combustion chamber apparatus 230 having a relatively small, pressurized chamber enclosure wall 264 composed of a heat-transmissive material with a high thermal conductivity. A preferred electronic ignition device 240 is operatively interconnected with the enclosure wall 264 in any of a number of known ways. The ignition device 240 provides an igniting spark for igniting the mixture of compressed gaseous fuel and compressed air. Such mixture enters the interior of the enclosure wall 264 under pressure through an orifice or nozzle device 265, which is preferably adjustable, and which causes the ignited fuel-gas mixture to be disbursed and spread out in a substantially even distribution pattern (represented by the flame 266) in order to evenly heat the interior side of the enclosure wall 264. The compressed gaseous fuel and the compressed air can be mixed outside of the enclosure wall 264, either in the above-described venturi device 32 and fed through a simple orifice device, or in a mixing chamber section 267 of an orifice assembly 265.

Figure 3:
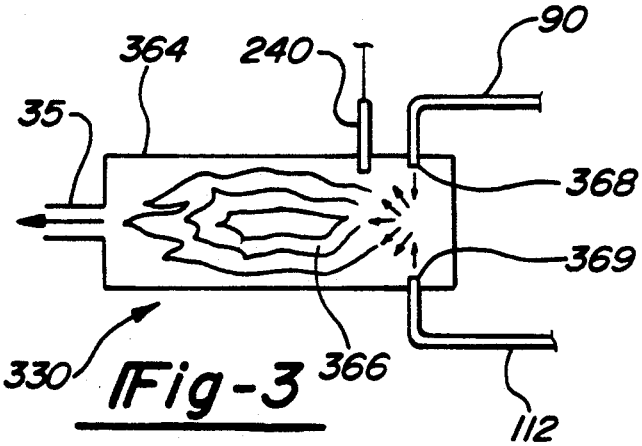
FIG. 3 is a detailed schematic representation of another embodiment of a combustion chamber for the heating system shown in FIG. 1.
Figure 3A:
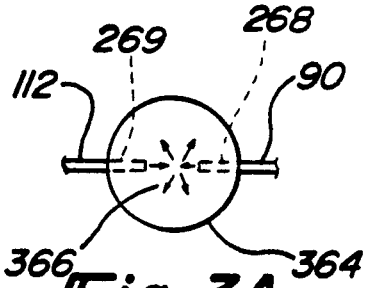
FIG. 3A is a schematic end view of the combustion chamber shown in FIG. 3.

In FIG. 3, the embodiment of the combustion chamber apparatus 230 is replaced by another embodiment, the combustion chamber apparatus 330. The apparatus 330 includes an enclosure wall 364, which is generally similar to the above-described enclosure wall 264, and the ignition device 240. The venturi device 32 or the orifice device 265 (both described above) is replaced, however, by a set of air and gas inlets 368 and 369, respectively, which are preferably disposed on opposite internal sides of the enclosure wall 364 as shown in FIG. 3A. The inlets 368 and 369 preferably extend partially into the interior of the enclosure wall 364 in a generally opposed and generally aligned relationship such that the entering compressed air stream and the entering compressed gas stream substantially impinge upon each other and intermix within the enclosure wall 364. Such an arrangement results in a disbursal or spreading out to form an evenly-distributed flame 366, which is accomplished due to the pressure of the compressed gas and fuel and due to the proximity of the inlets 368 and 369. Thus, the need for a venturi, orifice mixing chamber, or other external mixing device is eliminated, and an efficient, effective heat and flame 366 pattern is obtained and substantially evenly distributed about the internal side of the enclosure wall 364.

Figure 4:
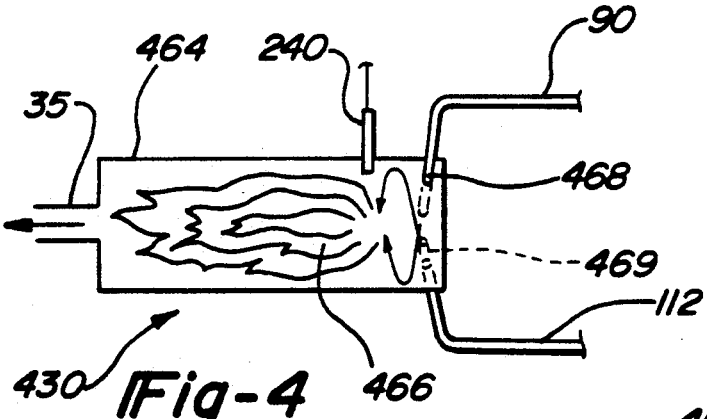
FIG. 4 is a detailed schematic representation of still another embodiment of a combustion chamber for the heating system shown in FIG. 1.
Figure 4A:
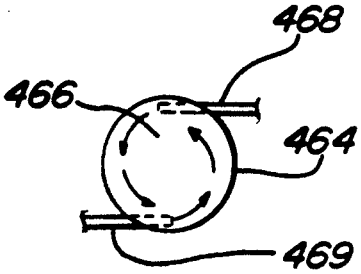
FIG. 4A is a schematic end view of the combustion chamber shown in FIG. 4.

A similar arrangement to that of FIG. 3 is provided in the embodiment of FIG. 4, except that the compressed air and gas inlets 468 and 469 are disposed on opposite internal sides of the enclosure wall 464 and arranged in a generally parallel but offset, or tangential, relationship in order to impart a spinning, or helical, pattern to the air and fuel, thus thoroughly mixing and spreading the flame of the ignited air and gas mixture, from one end of the enclosure to the other. This not only produces an efficient, even heat and flame disbursal or distribution, but also greatly enhances the air and gas mixing prior to, and during, ignition.

Figure 5:
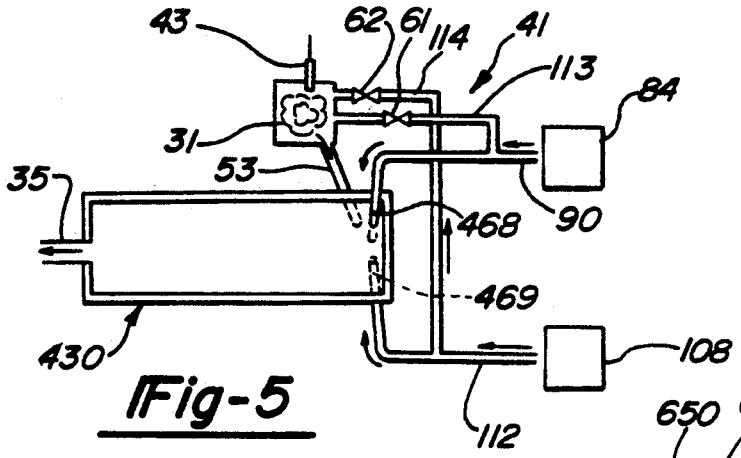
FIG. 5 is a schematic representation of a remote pilot system optionally employable in the various versions of the heating system of FIG. 1.

FIG. 5 schematically illustrates a remote pilot system 41 that can optionally be employed in lieu of the electronic ignition device 240 in any of the exemplary embodiments disclosed herein and in the above-mentioned previous U.S. Pat. No. 4,669,656. For purposes of illustration, however, the remote pilot system 41 is shown in FIG. 5 in conjunction with the combustion chamber apparatus 430 of FIG. 4.

The remote pilot system 41 includes air and gaseous fuel supply conduits 113 and 114, respectively, that provide fluid communication to a pilot combustion chamber 31 from the respective air and gas conduits 90 and 112 on the discharge side of the air and gas compressors 84 and 108, respectively. Appropriate shut-off or throttle valves 61 and 62 are provided in the air and gas conduits 113 and 114, respectively, in order to allow shut-down and/or throttling pressure or flow regulation of the air and gas flow to the pilot combustion chamber 31, and a preferred electronic ignition device 43 is provided to ignite the air and gas mixture in the pilot combustion chamber 31. It should also be noted that the valves 61 and 62 can be automated valves that are operated by the control sub-system 22 in conjunction with starting and stopping of the air and gas compressors 84 and 108, respectively, so that air and gas can be supplied to the pilot combustion chamber only when initial ignition of the fuel and air mixture in the combustion chamber 430 is needed.

Once the air and gas mixture in the pilot combustion chamber 31 has been ignited by the electronic ignition device 43, the ignited mixture expands to cause ignition of the air and gas mixture in the main combustion chamber 430, by way of the ignition conduit 33. This arrangement can prove to be very desirable, or even essential, for proper ignition in the combustion chamber 430. This is due to the fact that the air and gaseous fuel are pressurized to an elevated predetermined pressure, which can be in the range of 5 psig to 300 psig. In the quantities and pressures present in the combustion chamber 430, such a pressurized mixture can present some difficulties in terms of its capability to be ignited merely in response to a spark produced by the electronic ignition device 43. In this regard it should be noted that the valves 61 and 62 can be equipped with automatic operators so that they can be automatically opened, closed, or modulated in response to an appropriate signal from the microprocessor 130 discussed below.

In order to effectively transfer a very high percentage of the thermal energy produced in the combustion chamber 30 (230, 330 or 430) to the air that is introduced into the air mixing chamber 54, the combustion chamber heat exchanger 50 is preferably of a configuration that substantially fully envelopes the combustion chamber. The combustion chamber 30 (230, 330 or 430) is enclosed by a combustion chamber enclosure wall (264, 364 or 464) composed of a heat-transmissive material having a high thermal conductivity in any of the exemplary embodiments of the combustion chamber heat exchanger 50 shown schematically in FIGS. 6 through 8. It should be noted that the embodiments of FIGS. 6 through 8 can be employed in conjunction with any of the exemplary combustion chamber embodiments and other embodiments or features disclosed herein.

Figure 6:
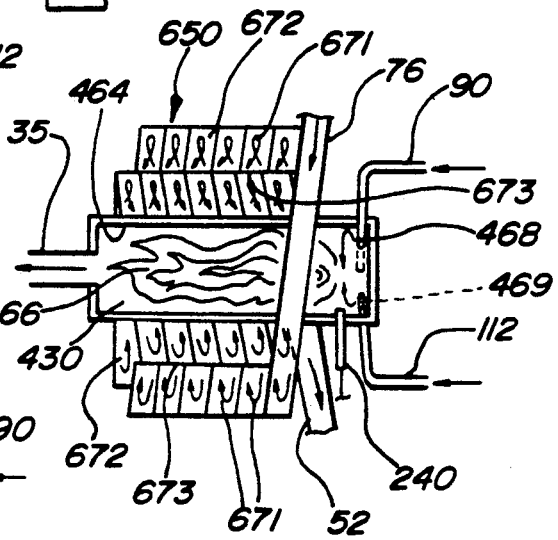
FIG. 6 is a detailed schematic illustration of one embodiment of a heat exchanger apparatus for the various versions of the heating system of FIG. 1.

In FIG. 6, one of the embodiments of the combustion chamber heat exchanger 50 is schematically represented by the heat exchanger 650, which is shown for purposes of illustration as used in conjunction with the combustion chamber 430 of FIG. 4. The heat exchanger 650 includes an outer helical cold air chamber 671 and an inner helical cold air chamber 672 generally surrounding the combustion chamber enclosure wall 464. The inner and outer helical chambers 672 and 671 are separated by a heat transmissive intermediate wall 673, surrounded by an outer wall 675. The chambers 671 and 672 are preferably arranged in a serial flow pattern such that cold return air from the cold air conduit 76 first enters the outer helical chamber 671, and flows helically through and annularly therethrough, preferably in a first direction along the combustion chamber, and then flows helically and annularly through the inner helical chamber 672, preferably in a second, opposite direction, to exit the heat exchanger 650 by way of the heated air discharge conduit 52. Some advantages of such an arrangement include the more even heat extraction from the combustion chamber, as well as the fact that any heat loss from the inner helical chamber 672 is directed to the cold return air in the outer helical chamber 671, thus increasing the overall efficiency of the system.

Figure 7:
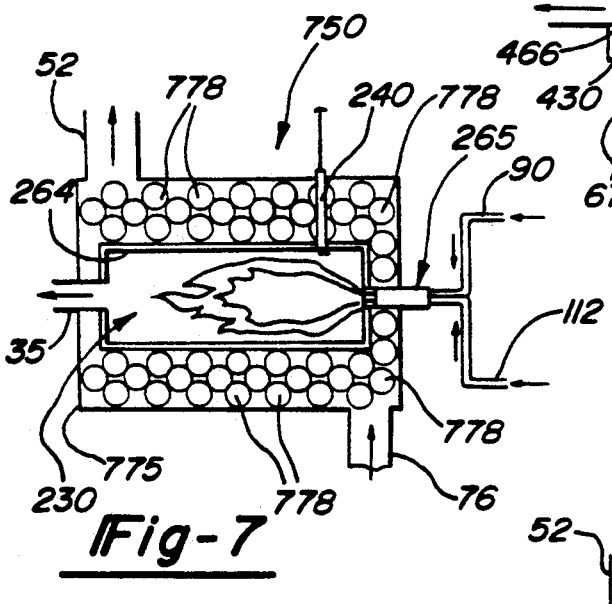
FIG. 7 is a detailed schematic illustration similar to that of FIG. 6, but depicts another heat exchanger embodiment.
Figure 8:
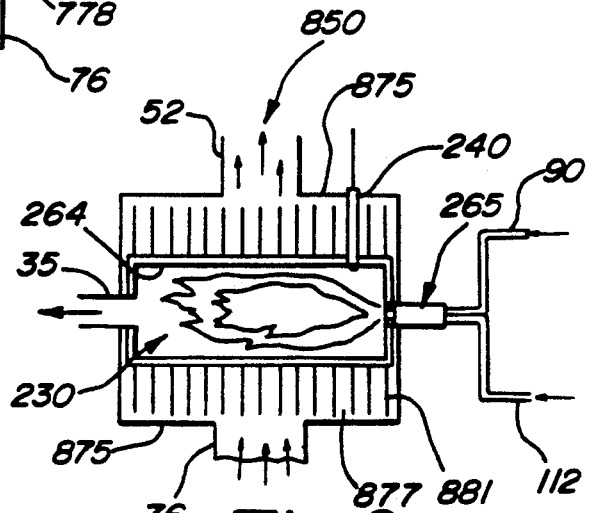
FIG. 8 is another detailed schematic representation similar to that of FIGS. 6 and 7, but illustrating still another heat exchanger embodiment.

Similar advantages, among others, are achieved by the embodiments of the heat exchanger 50 designated as 750 and 850 in FIGS. 7 and 8, respectively, which can be used in conjunction with any of the embodiments of the invention described herein, even though they are schematically shown merely for purposes of illustration in conjunction with the combustion chamber 230 of FIG. 2.

The heat exchanger 750 in FIG. 7 includes an enclosure cold air chamber 777 generally surrounding the combustion chamber enclosure wall 264, with a number of heat transmissive members 778 loosely packed within the chamber 777 so as to minimize the restriction on the air flow through the chamber 777 from the cold air conduit 76. The members 778 can be metallic, or composed of other known heat transmissive materials, preferably solid and spherical, although non-solid constructions or non-spherical shapes can also be advantageously employed. The presence of the heat transmissive members 778 contributes significantly to the even heat transfer and distribution of thermal energy from the combustion chamber to the cold return air being heated in the heat exchanger 750, thus improving the overall efficiency of the system.

In FIG. 8, the exemplary heat exchanger embodiment 850 achieves its increased efficiency and even heat transfer and distribution by including a number of heat transmissive fins or other protrusions 881 projecting outwardly from the combustion chamber enclosure wall 264 into the chamber 877, which generally surrounds the combustion chamber and is defined by an outer wall 875. Preferably the fins 881 are in contact or interconnected with the combustion chamber enclosure wall 264 for conductive heat transfer therefrom, which is significantly enhanced due to the greatly increased surface area compared to that of the combustion chamber enclosure wall 264 alone. The fins 881 can be arranged in a parallel, straight relationship, a helical configuration, or other arrangements that will occur to those skilled in the art. Like the other exemplary heat exchanger embodiments described herein, the heat exchanger 850 provides for increased efficiency and more even heat distribution when heating the cold return air from the conduit 76.

The size and number of the cold air chambers or enclosures surrounding or enveloping the combustion chamber is readily determined by one skilled in the art from the desired cold air inlet and heated air outlet temperatures for a given air flow in a particular application. Optionally, the outer heat exchanger enclosures 68 can be covered or surrounded by any of a number of well-known suitable heat insulating materials in order to further minimize thermal energy loss.

The combustion air supply sub-system 18 shown in FIG. 1 preferably includes a combustion air cleaner or filter device 80, which can comprise any of a number of well-known suitable air cleaner or air filter intake devices known to those skilled in the art. Combustion air is withdrawn from the heated space 48 through the combustion air cleaner device 80, and conveyed through an air conduit 82 to the intake or suction side 83 of a combustion air compressor 84. The combustion air compressor 84 raises the pressure of the combustion air to a predetermined pressure level and discharges the compressed combustion air through its discharge side 85 to the air heating sub-system 12 by way of an air conduit 86.

Prior to being introduced into the adjustable venturi device 32, the compressed combustion air preferably passes through a separator device 88. The separator device 88 is preferably a vortex-type separator device, such as those well-known to persons skilled in the art, preferably equipped with a noise-reducing muffler 89. The separator device 88 functions to separate combustion air that is above a predetermined temperature from combustion air that is below such predetermined temperature by separating the relatively heavy, cooler air molecules from the relatively light, higher temperature air molecules. The separated combustion air that is above such predetermined temperature is conveyed through a hot separated air conduit 90 to the adjustable venturi device 32, described above, to be intermixed with gaseous fuel from the gaseous fuel supply sub-system 20 described below.

The separated combustion air that is below the above-discussed predetermined temperature is separated in the separator device 88 and conveyed by way of a cold separated air conduit 92 to an exhaust gas heat exchanger 94 shown generally in FIG. 1, and diagrammatically depicted in more detail in FIG. 9.

As shown in FIG. 9, the optional exhaust gas heat exchanger 94 preferably includes a plurality of exhaust gas baffles 95 disposed within an inner housing 93. The inner housing 93 is generally surrounded or enveloped by an outer housing 91, which is spaced outwardly apart from the inner housing 93 to allow air from the cold separated air conduit 92 to flow therebetween and to be discharged through an air conduit 96 to the air mixing chamber 54 described above. Preferably, a number of air baffles 97 are disposed in the space between the inner and outer housings 93 and 91, respectively, in order to cause the air flowing therethrough to flow evenly over substantially all of the inner housing 93, thereby effectively transferring heat from the exhaust gas, which may be in the range of approximately 300 F. (149 C.) to approximately 360 F. (182 C.) in many operating conditions, to the air flowing through the exhaust gas heat exchanger 94. By such an arrangement, and by choosing an appropriately-sized exhaust gas heat exchanger 94, as is well within the capabilities of one skilled in the art, a substantial portion of the thermal energy contained in the exhaust gas can be recovered such that the exhaust gas discharged to the exterior ambient surroundings 46 is at a very low temperature, preferably below the temperature desired in the heated space 48, such as at or below 60 F. (16 C.), for example, in many applications. Furthermore, because of the relatively low temperature of the exhaust gas, the exhaust gas conduit 44 can advantageously be constructed of relatively common conduit materials, including common copper tubing, for example, in many applications.

The gaseous fuel supply sub-system 20 is illustrated in FIG. 1, wherein a gaseous fuel is withdrawn from a gas source 102, which can consist of a conventional natural gas supply system or other gaseous fuel sources well-known in the art. The gaseous fuel is conveyed through a safety valve 104, which is preferably adapted to be automatically closed or to automatically fail in a closed condition in the event of a malfunction in the heating system 10. The gaseous fuel is then conveyed through the gas conduit 103 into the intake or suction side 106 of a gaseous fuel compressor 108, which raises the pressure of the incoming gaseous fuel to a predetermined pressure level substantially equal to that of the compressed combustion air described above. The compressed gaseous fuel is then expelled through the discharge side 110 of the gaseous fuel compressor 108 and conveyed by way of a gaseous conduit 112 to the above-described adjustable venturi device 32, wherein it is intermixed at predetermined proportions with the compressed combustion air before being ignited by the ignition device 40 and injected into the combustion chamber 30.

Because of the elevated pressure of the combustion air and the gaseous fuel, typically in the range of approximately 5 psig to approximately 300 psig, the exhaust gases are also pressurized and thus forcibly conveyed through the exhaust gas conduit 44. Therefore, the exhaust gas conduit 44 does not have to be connected to a draft-type chimney or other conduit and can be relatively small, perhaps as small as a ½ inch (1.3 cm.) or (0.95 cm.) copper tubing, or even smaller, in certain applications.

In order to control the flow rates of the combustion air and gaseous fuel being supplied to the air heating sub-system 12 by the combustion air supply sub-system 18 and the gaseous fuel supply sub-system 20, bypass systems are included in association with the combustion air compressor 84 and the gaseous fuel air compressor 108, respectively. In the combustion air supply sub-system 18, a bypass conduit 116 is connected in fluid communication with the air conduits 86 and 82 in order to allow bypass air flow from the discharge side 85 to the suction or intake side 83 of the combustion air compressor 84. The flow rate of the combustion air flowing through the bypass conduit 116, and thus the discharge flow rate through the air conduit 86, are controlled by modulating an air control valve 118 provided in the bypass conduit 116. Similarly, a bypass conduit 120 is provided in fluid communication with the gaseous conduits 112 and 103 in order to allow gaseous fuel bypass flow from the discharge side 110 to the intake or suction side 106 of the gaseous fuel compressor 108, with the gaseous fuel bypass flow rate being controlled by modulation of a gas control valve 122. Thus, the respective pressures and flow rates of both the combustion air flow and the gaseous fuel flow can be preselectively regulated by modulating the combustion air control valve 118 and the gaseous fuel control valve 122, respectively. Further regulation of these flow rates can optionally be accomplished by regulating the speeds of variable-speed gas and air compressors in addition to, or in lieu of, the bypass systems described above. Regulation of the combustion air supply and the gaseous fuel supply is accomplished by the control sub-system 22 described below.

The control sub-system 22 includes an air temperature sensor 126 located in the heated space 48 and can consist of a conventional thermostat device such as that well-known in the art. The air temperature sensor 126 is operatively connected by way of a suitable conductor 128 with a preferably programmable central microprocessor 130 and is adapted to transmit signals to the central microprocessor 130 in response to varying air temperatures in the heated space 48. The central microprocessor 130 is in turn operatively connected by way of suitable conductors 133 and 135 to the combustion air control valve 118 and the gaseous fuel control valve 122, respectively, in order to transmit appropriate signals for actuating, deactuating, or modulating the respective air and gas bypass systems. The central microprocessor 130 is also in turn operatively connected with the combustion air compressor 84 and the gaseous fuel compressor 108 by suitable conductors 132 and 134, respectively, in order to transmit appropriate signals thereto for purposes of actuating, deactuating, or regulating the speed of, the combustion air compressor 84 and the gaseous fuel compressor 108. The central microprocessor 130 is also operatively connected with the electronic ignition device 40 by way of a suitable conductor 136 in order to transmit actuating or deactuating signals thereto for purposes of igniting the mixture of combustion air and gaseous fuel during start-up of the heating system 10, and with the safety valve 104, by way of conductor 105 in order to shut down the system in the event of an emergency or a malfunction.

The control sub-system 22 also includes suitable conductors 150 and 152 for electrically interconnecting the central microprocessor 130 with the cold air supply fan 74 of the cold air supply sub-system 14 and the return air fan 58 of the air circulating sub-system 16. The control sub-system 22 is thus adapted to transmit actuating and deactuating signals, or modulating signals, to both the cold air supply sub-system 14 and the air circulating sub-system 16. By way of this control arrangement, as well as the control arrangement discussed above in connection with the combustion air supply and the gaseous fuel supply, the central microprocessor 130 is adapted to control the heating system 10 in response to sensed air temperatures in the heated space 48 and thereby maintain the air temperature in the heated space 48 at any of a number of preselected temperatures.

Because the ambient temperatures and conditions in the surroundings or exterior 46 of the heated space 48 can have a dramatic effect upon the air temperature in the heated space 48 by way of heat loss or heat gain, it is desirable to also control the operation of the heating system 10 in response to outside temperatures. Therefore, the control sub-system 22 optionally, but preferably, includes an outside air temperature sensor 140 operatively and electrically connected by way of a suitable conductor 142 with the central microprocessor 130. In response to sensed outside temperatures, the outside air temperature sensor 140 can therefore transmit appropriate signals to the central microprocessor 130, which in turn can preferably be programmable to control the heating system 10 in response to signal inputs relating to both the internal air temperature of the heated space 48 and the outside temperature of the exterior surroundings 46. For example, the central microprocessor 130 can preferably be programmed to respond appropriately in a situation where the heated space air temperature sensor 126 calls for heated air but the outside temperature is concurrently increasing, thereby avoiding the duplicative effect of adding heat to the heated space 48 by the heating system 10 while the heated space 48 is also experiencing a heat gain as a result of increasing outside temperatures. Likewise, for example, the central microprocessor 130 can be programmed to respond to decreasing outside temperature in order to cause the heating system 10 to supply additional heated air to the heated space 48 somewhat before the internal air temperature sensor 126 actually calls for more heat. Furthermore, by maintaining close control of the operation of the heating system 10, by way of the above-described control sub-system 22, the heating system 10 can be operated for longer periods of time, but at variable heat output levels, thereby decreasing the number of on/off operating cycles and thus decreasing the opportunity for wasteful heat loss as compared with conventional furnaces and other conventional heating systems.

It should be noted that the central microprocessor 130 can consist of any of a number of conventional, and preferably programmable, microprocessor units well-known to those skilled in the art and adaptable for performing the functions described above. In this regard, it should also be noted that although the control sub-system 22 is schematically depicted in the drawings as an electric control system, one skilled in the art will readily recognize that pneumatic, hydraulic or other control systems for actuating and deactuating the various components described above can readily be substituted for the electric control sub-system 22 depicted for purposes of illustration in the drawings.

The foregoing discussion discloses and describes exemplary embodiments of the present invention. One skilled in the art will readily recognize from such discussion that various changes, modifications and variations may be made therein without departing from the spirit and scope of the invention as defined in the following claims.

What is claimed is:

1. A heating system for heating a space, said heating system comprising:

air heating means including a combustion chamber with means for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space; and said combustion chamber heat exchanger including a heat transmissive enclosure wall defining said combustion chamber, said enclosure wall being generally surrounded by an inner helical cold air chamber, said inner helical cold air chamber being surrounded by at least an outer helical cold air chamber with said inner and outer helical cold air chambers being separated by a heat transmissive wall, said inner and outer helical cold air chambers being in fluid communication with one another for flow of said cold air serially therethrough from said outer helical cold air chamber to said inner helical cold air chamber, said heat in said combustion chamber being transferred outwardly from said combustion chamber serially through said heat transmissive enclosure wall and serially through said cold air chambers from said inner helical cold air chamber to said outer helical cold air chamber in order to transfer said heat to said cold air.

2. A heating system according to claim 1, wherein said intake means of said air heating means includes mixing and disbursal means for mixing said combustion air and said gaseous fuel and for spreading said burning air-and-fuel mixture over a substantial portion of the interior of said combustion chamber.

3. A heating system according to claim 2, wherein said mixing and disbursal means comprises a nozzle in fluid communication with the interior of said combustion chamber.

4. A heating system according to claim 2, wherein said mixing and disbursal means comprises a fuel inlet conduit in fluid communication with said gaseous fuel supply means, and an air inlet conduit in fluid communication with said combustion air supply means, said fuel and air inlet conduits each having an open end and each extending into said combustion chamber with their open ends generally in an opposed and generally aligned relationship with respect to one another therein in order to direct the flows of said combustion air and said gaseous fuel generally toward one another so as to cause said mixing of said combustion air and said gaseous fuel and said spreading of said burning air-and-fuel mixture.

5. A heating system according to claim 2, wherein said mixing and disbursal means comprises a fuel inlet conduit in fluid communication with said gaseous fuel supply means, and air inlet conduit in fluid communication with said combustion air supply means, said fuel and air inlet conduits each having an open end and each extending into said combustion chamber with their open ends generally in an opposed and offset relationship with respect to one another therein in order to impart a generally helical flow pattern to said combustion air and said gaseous fuel entering the combustion chamber so as to cause said mixing of said combustion air and said gaseous fuel and said spreading of said burning air-and-fuel mixture.

6. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space; and said combustion chamber heat exchanger including a heat transmissive enclosure wall defining said combustion chamber, said enclosure wall being generally surrounded by a cold air chamber, said cold air chamber having a plurality of heat transmissive members loosely disposed therein to allow flow of cold air therethrough, said heat in said combustion chamber being transferred outwardly from said combustion chamber to both said cold air and said heat transmissive members in said cold air chamber, and said heat transmissive members also transferring heat to said cold air in order to transfer said heat generally uniformly to said cold air flowing through said cold air chamber.

7. A heating system according to claim 6, wherein said intake means of said air heating means includes mixing and disbursal means for mixing said combustion air and said gaseous fuel and for spreading said burning air-and-fuel mixture over a substantial portion of the interior of said combustion chamber.

8. A heating system according to claim 7, wherein said mixing and disbursal means comprises a nozzle in fluid communication with the interior of said combustion chamber.

9. A heating system according to claim 7, wherein said mixing and disbursal means comprises a fuel inlet conduit in fluid communication with said gaseous fuel supply means, and an air inlet conduit in fluid communication with said combustion air supply means, said fuel and air inlet conduits each having an open end and each extending into said combustion chamber with their open ends generally in an opposed and generally aligned relationship with respect to one another therein in order to direct the flows of said combustion air and said gaseous fuel generally toward one another so as to cause said mixing of said combustion air and said gaseous fuel and said spreading of said burning air-and-fuel mixture.

10. A heating system according to claim 7, wherein said mixing and disbursal means comprises a fuel inlet conduit in fluid communication with said gaseous fuel supply means, and air inlet conduit in fluid communication with said combustion air supply means, said fuel and air inlet conduits each having an open end and each extending into said combustion chamber with their open ends generally in an opposed and offset relationship with respect to one another therein in order to impart a generally helical flow pattern to said combustion air and said gaseous fuel entering the combustion chamber so as to cause said mixing of said combustion air and said gaseous fuel and said spreading of said burning air-and-fuel mixture.

11. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space; and said combustion chamber heat exchanger including a heat transmissive enclosure wall defining said combustion chamber, said enclosure wall being generally surrounded by a cold air chamber, said cold air chamber having a plurality of heat transmissive fins protruding outwardly from said combustion chamber and extending into said cold air chamber, at least a portion of said heat in said combustion chamber being transferred outwardly from said combustion chamber serially through said heat transmissive fins to said cold air.

12. A heating system according to claim 11, wherein said intake means of said air heating means includes mixing and disbursal means for mixing said combustion air and said gaseous fuel and for spreading said burning air-and-fuel mixture over a substantial portion of the interior of said combustion chamber.

13. A heating system according to claim 12, wherein said mixing and disbursal means comprises a nozzle in fluid communication with the interior of said combustion chamber.

14. A heating system according to claim 12, wherein said mixing and disbursal means comprises a fuel inlet conduit in fluid communication with said gaseous fuel supply means, and an air inlet conduit in fluid communication with said combustion air supply means, said fuel and air inlet conduits each having an open end and each extending into said combustion chamber with their open ends generally in an opposed and generally aligned relationship with respect to one another therein in order to direct the flows of said combustion air and said gaseous fuel generally toward one another so as to cause said mixing of said combustion air and said gaseous fuel and said spreading of said burning air-and-fuel mixture.

15. A heating system according to claim 12, wherein said mixing and disbursal means comprises a fuel inlet conduit in fluid communication with said gaseous fuel supply means, and air inlet conduit in fluid communication with said combustion air supply means, said fuel and air inlet conduits each having an open end and each extending into said combustion chamber with their open ends generally in an opposed and offset relationship with respect to one another therein in order to impart a generally helical flow pattern to said combustion air and said gaseous fuel entering the combustion chamber so as to cause said mixing of said combustion air and said gaseous fuel and said spreading of said burning air-and-fuel mixture.

16. A heating system for heating a space, said heating system comprising:

air heating means including a main combustion chamber with means for burning a mixture of combustion air and a gaseous fuel in order to produce heat therein, a combustion chamber heat exchanger for transferring heat from said main combustion chamber to cold air from said space, intake means in fluid communication with said combustion chamber for supplying said mixture of said combustion air and gaseous fuel thereto, and exhaust means for discharging products of combustion from said main combustion chamber;

combustion air supply means for conveying combustion air to said air heating means, said combustion air supply means including a combustion air compressor for raising the pressure of said combustion air to a predetermined pressure level;

gaseous fuel supply means for conveying a gaseous fuel from a gaseous fuel source to said air heating means, said gaseous fuel supply means including a gaseous fuel compressor for raising the pressure of said gaseous fuel to said predetermined pressure level;

said predetermined pressure level of said combustion air and said gaseous fuel being sufficient to forcibly convey said mixture of combustion air and gaseous fuel into said main combustion chamber and to forcibly convey said products of combustion through said exhaust means; and remote pilot means for igniting said combustion air and said gaseous fuel in said main combustion chamber, said remote pilot means including a pilot combustion chamber smaller than said main combustion chamber in fluid communication with said combustion air supply means and said gaseous fuel supply means, ignition means selectively operable for igniting a pilot mixture of said combustion air and said gaseous fuel in said pilot combustion chamber, and an ignition conduit in fluid communication with said pilot combustion chamber and said main combustion chamber for conveying an ignited pilot mixture from said pilot combustion chamber to said main combustion chamber.

17. A heating system according to claim 16, wherein said intake means of said air heating means includes mixing and disbursal means for mixing said combustion air and said gaseous fuel and for spreading said burning air-and-fuel mixture over a substantial portion of the interior of said combustion chamber.

18. A heating system according to claim 17, wherein said mixing and disbursal means comprises a nozzle in fluid communication with the interior of said combustion chamber.

19. A heating system according to claim 17, wherein said mixing and disbursal means comprises a fuel inlet conduit in fluid communication with said gaseous fuel supply means, and an air inlet conduit in fluid communication with said combustion air supply means, said fuel and air inlet conduits each having an open end and each extending into said combustion chamber with their open ends generally in an opposed and generally aligned relationship with respect to one another therein in order to direct the flows of said combustion air and said gaseous fuel generally toward one another so as to cause said mixing of said combustion air and said gaseous fuel and said spreading of said burning air-and-fuel mixture.

20. A heating system according to claim 17, wherein said mixing and disbursal means comprises a fuel inlet conduit in fluid communication with said gaseous fuel supply means, and air inlet conduit in fluid communication with said combustion air supply means, said fuel and air inlet conduits each having an open end and each extending into said combustion chamber with their open ends generally in an opposed and offset relationship with respect to one another therein in order to impart a generally helical flow pattern to said combustion air and said gaseous fuel entering the combustion chamber so as to cause said mixing of said combustion air and said gaseous fuel and said spreading of said burning air-and-fuel mixture.

21. A heating system according to claim 16, wherein said combustion chamber heat exchanger includes a heat transmissive enclosure wall defining said combustion chamber, said enclosure wall being generally surrounded by an inner helical cold air chamber, said inner helical cold air chamber being surrounded by at least an outer helical cold air chamber with said inner and outer helical cold air chambers being separated by a heat transmissive wall, said inner and outer helical cold air chambers being in fluid communication with one another for flow of said cold air serially therethrough from said outer helical cold air chamber to said inner helical cold air chamber, said heat in said combustion chamber being transferred outwardly from said combustion chamber serially through said heat transmissive enclosure wall and serially through said cold air chambers from said inner helical cold air chamber to said outer helical cold air chamber in order to transfer said heat to said cold air.

22. A heating system according to claim 16, wherein said combustion chamber heat exchanger includes a heat transmissive enclosure wall defining said combustion chamber, said enclosure wall being generally surrounded by a cold air chamber, said cold air chamber having a plurality of heat transmissive members loosely disposed therein to allow flow of cold air therethrough, said heat in said combustion chamber being transferred outwardly from said combustion chamber to both said cold air and said heat transmissive members in said cold air chamber, and said heat transmissive members also transferring heat to said cold air in order to transfer said heat generally uniformly to said cold air flowing through said cold air chamber.

23. A heating system according to claim 16, wherein said combustion chamber heat exchanger includes a heat transmissive enclosure wall defining said combustion chamber, said enclosure wall being generally surrounded by a cold air chamber, said cold air chamber having a plurality of heat transmissive fins protruding outwardly from said combustion chamber and extending into said cold air chamber, at least a portion of said heat in said combustion chamber being transferred outwardly from said combustion chamber serially through said heat transmissive fins to said cold air.

* * * * *